US011286541B2

(12) United States Patent
Filmer et al.

(10) Patent No.: US 11,286,541 B2
(45) Date of Patent: Mar. 29, 2022

(54) PROCESSING OF LATERITE ORES

(71) Applicant: ANGLO AMERICAN SERVICES (UK) LTD, London (GB)

(72) Inventors: Anthony Owen Filmer, Kangaroo Point (AU); Daniel John Alexander, London (GB); Claudia Villa Diniz, Minas Gerais (BR)

(73) Assignee: ANGLO AMERICAN TECHNICAL & SUSTAINABILTY SERVICES, LTD., London (GB)

( * ) Notice: Subject to any disclaimer, the term of this patent is extended or adjusted under 35 U.S.C. 154(b) by 41 days.

(21) Appl. No.: 16/446,676

(22) Filed: Jun. 20, 2019

(65) Prior Publication Data

US 2019/0390300 A1 Dec. 26, 2019

Related U.S. Application Data

(60) Provisional application No. 62/688,610, filed on Jun. 22, 2018.

(30) Foreign Application Priority Data

Sep. 27, 2018 (GB) ..... 1815744

(51) Int. Cl.
*C22B 3/02* (2006.01)
*C22B 3/00* (2006.01)
(Continued)

(52) U.S. Cl.
CPC ..... *C22B 23/0407* (2013.01); *C22B 3/02* (2013.01); *C22B 23/005* (2013.01); *C22B 23/023* (2013.01); *C22B 23/025* (2013.01)

(58) Field of Classification Search
CPC ..... C22B 23/0407; C22B 3/02; C22B 23/005; C22B 23/023; C22B 23/025
See application file for complete search history.

(56) References Cited

U.S. PATENT DOCUMENTS 3,991,159 A 11/1976 Queneau et al.
6,680,035 B2 1/2004 Arroyo et al.
(Continued)

FOREIGN PATENT DOCUMENTS

RU 2 471 563 C1 1/2013
WO WO 2012/016286 A1 2/2012

OTHER PUBLICATIONS

Bao, C. et al., "Valuing flexible operating strategies in nickel production under uncertainty", Proc, of the 20$^{th}$ International Congress on Modeling and Simulation, Adelaide, Australia, Dec. 1-6, 2013, pp. 1426-1432.
(Continued)

*Primary Examiner* — Scott R Kastler
(74) *Attorney, Agent, or Firm* — Nixon Peabody LLP; Jeffrey L. Costellia

(57) ABSTRACT

This invention relates to a method for processing nickel laterite ore, including the steps of obtaining a mined laterite ore from a mining operation 42; and feeding the ore through a bulk sorter 44 comprising a sensor arrangement and a diverting mechanism that separates the ore into a beneficiated stream of nickel laterite ore 28 wherein the grade of nickel is higher than the grade of the ore fed into the bulk sorter for further processing 52 by leaching or smelting; one or more low grade fractions of ore 50 with a lower nickel grade than the beneficiated stream; and a waste fraction 46. This configuration efficiently separates lower grade patches in the run of mine ore, to either a low-grade stockpile or waste, and efficiently blends the selected high-grade ore to meet the specifications of the subsequent processing.

30 Claims, 5 Drawing Sheets

(51) Int. Cl.
*C22B 23/02* (2006.01)
*C22B 23/00* (2006.01)

(56) References Cited

U.S. PATENT DOCUMENTS

| | | | | |
|---|---|---|---|---|
| 9,316,537 | B2 † | 4/2016 | Bamber | |
| 9,958,407 | B2 † | 5/2018 | Bamber | |
| 2014/0260801 | A1 * | 9/2014 | Wellwood | G01N 25/005 75/392 |
| 2014/0260802 | A1 * | 9/2014 | Kingman | B07C 5/363 75/392 |
| 2014/0346091 | A1 * | 11/2014 | Kingman | B07B 13/003 209/3.1 |

OTHER PUBLICATIONS

Da Silveira Reple, A.C., "Bulk ore sorter: um estudo de caso na mina Phu Kham", Masters Thesis, Escola Politecnica da Sao Paulo, Jan. 1, 2017, pp. 1-75.
Dalvi, Ashok et al., "The Past and the Future of Nickel Laterites", PDAC 2004 International Convention. Trade Show & Investors Exchange, Mar. 7-10, 2004, pp. 1-27.
Whittington, B.I. et al., "Pressure Acid Leaching of Nickel Laterites: A Review", Mineral Processing and Extractive Metullargy Review. 21:6. pp. 527-599.
Kurth, H., Optimising plant feed quality and process performance using Geoscan Elemental Analysis in Proceedings MetPlant, 2015, (The Australasian Institute of Mining and Metallurgy: Melbourne), pp. 373-380.
Duffy et al, Integrating Bulk Ore Sorting into a Mining Operation to Maximise Profitability, pp. 273-287, Sep. 2015, Metallurgical Plant Design and Operating Strategies, at Perth, Australia.†
Bob McCarthy, Introducing Bulk Sorting: its Enablers, Application, and Potential, 35 pages, Apr. 27, 2018, www.srk.co.uk/sites/default/files/file/BMcCarthy_BulkOreSorting_2018.pdf.†
Materials World Magazine, Sorting Out Low-Grade Nickel Ores, 4 pages, Jan. 1, 2011, https://www.iom3.org/materials-world-magazine/news/2011/jan/01/sorting-out-lowgrade-nickel-ores.†
Klein et al, SME Mineral Processing and Extractive Metallurgy Handbook, pp. 329-351, 2018, Mineral Sorting.†
Klein et al "SME Mineral Processing and Extractive Metallurgy Handbook," Mineral Sorting, Chapter 4.4, pp. 329-351, 2018.†
Bob McCarthy "Introducing Bulk Sorting: its Enablers, Application, and Potential," www.srk.co.uk/sites/default/files/ file/BMcCarthy_BulkOreSorting_2018.pdf, Apr. 27, 2018, 35 pages.†
Duffy, et al, "Integrating Bulk Ore Sorting into a Mining Operation to Maximise Profitability," Metallurgical Plant Design and Operating Strategies, at Perth, Australia; Sep. 2015, pp. 273-287.†
Materials World Magazine "Sorting Out Low-Grade Nickel Ores," https://www.iom3.org/materials-world-magazine/news/2011/jan/01/sorting-out-lowgrade-nickel-ores Jan. 1, 2011, 4 pages.†

* cited by examiner
† cited by third party

PROCESSING OF LATERITE ORES

BACKGROUND OF THE INVENTION

Nickel ores are naturally found in the form of sulphides, and in an oxide form as laterites. The laterites can be further subdivided into two categories, limonites which are typically lower in nickel and magnesium grade, and higher in iron and cobalt; and saprolites which have a higher nickel and magnesia grades, but less cobalt.

The geological structure of the laterites is results from weathering, and is typically a limonite layer, overlaying the saprolite. Horizons in the orebody are not usually regular.

The processing of the lower grade limonites containing nickel and cobalt is usually via leaching technologies, either at high temperature and pressure, or more slowly in heaps. The saprolites containing mainly nickel values, usually consume too much acid for leaching and hence represent 'waste' in the limonitic leach feed.

The processing of saprolites is usually via smelting to form ferronickel, or matte. The limonite fraction of ore is typically too low in nickel grade to be smelted economically, and hence represents 'waste' in the smelter feed. The limonite also contains cobalt and sometimes copper, which can cause problems when the ferronickel is used for stainless steel production.

In addition to the importance of nickel grade on the viability of processing an ore, the gangue content can also prove problematic. For example, the fluidity of the slag phase formed during smelting requires a feed with specific magnesium to silicon ratios.

Nickel laterites are unusual in the base metals industry, in that the ore cannot be readily beneficiated prior to processing (Reference 1).

In contrast, nickel sulphide ores are typically of similar nickel grade to laterites, but can be beneficiated by flotation, to produce a much higher-grade concentrate which is then smelted.

This implies that along with the nickel in laterites, all the associated gangue must be processed in capital and energy intensive processes like smelting or pressure leaching. Due to the large proportion of gangue in the ore (typically over 98%), energy, consumables, and transport costs of processing the ore are high. Thus, the processing must usually be located close to the orebody, rather than a more distant location where better infrastructure and residue disposal options may exist.

This beneficiation constraint restricts the use of the reasonably abundant nickel laterite resources, to those that are sufficiently high grade and long life to justify the major capital investment in the processing equipment and infrastructure. Many known laterite resources remain undeveloped, because their nickel grade or size cannot justify the high cost of processing.

For these reasons, beneficiating the nickel content of the lateritic ore has long been a desire of the metallurgical world, but no broadly applicable technique has been found. This is probably due to the incorporation of the nickel into the gangue matrix, unlike many other base metals which exist as discrete high grade mineral particles in amongst the bulk of the gangue. The only beneficiating technique that has gained any commercial success for laterites is screening, which can sometimes be used to remove silica rich oversize from the remainder of the nickel laterite, and hence modestly increasing the nickel grade (Reference 2).

The screening process is not applicable to all ore types, and is also very difficult to operate with sticky ore which is mined in the wet season.

Nor can the nickel laterites be selectively mined to recover only the high-grade areas, at a scale which is consistent with the requirements of a commercial operation. The nickel grade in laterite ores is very heterogeneous. Exhaustive sampling would be required to selectively identify and mine the high-grade zones of ore, and then selective mining would require very small equipment.

This heterogeneity is typically non-uniform across the orebody in any dimension, including both the location of the limonite/saprolite/waste rock stratification, and also within each of the nickel laterite layers. The high-grade zones are interspersed with low grade zones, and are not uniformly more concentrated near the surface or the base of the orebody. The different ore grades are also not readily visible.

The conventional method to estimate the grade of nickel in laterite ores, and determine whether it is suitable for processing or should be disposed as waste, is grade control drilling. This drilling collects samples of ore across a matrix of the orebody for laboratory analysis, and depending on the results, geologists interpolate the grades, and select and Thark-up' the ore and waste to be mined.

The estimated grade of the intervening block of ore is approximate. In a heterogeneous ore like nickel laterite, this method of estimation is more prone to error in nickel, impurity and gangue compositions, than in a more consistent orebody.

Whilst the optimum drill spacing used for grade control drilling of nickel laterites is around 10-15 m, and closer than typical in the base metals industry, it is still much too widely spaced to selectively identify the higher-grade patches of a laterite ore.

And even if grade control drilling were very closely spaced, and techniques such as high precision global positioning systems were used to spatially control the coordinates for ore loading, the variability in the vertical dimension of the orebody would prevent any practical form of selective mining.

Hence the normal procedure for mining is to select an economic cut-off grade, drill and sample to estimate the metal grade, and mine the highest-grade blocks available. In some cases, leaving the lower grade areas of the resource for later in the mine life.

The grade control drilling also has an extra function in nickel laterite mining. The processing of laterites requires the gangue elements to be within specifications set for downstream processing. For example, the silica to magnesia ratio must be tightly controlled to ensure the fluidity of the slag in smelting. Or the magnesium content of ores processed by leaching has a direct influence on acid consumption. The silica and magnesia contents of the ore can also vary widely across both the vertical and horizontal dimensions of the nickel laterite orebody. Thus, mining of the different zones must be followed by blending, and selective mining to meet gangue specifications is again not possible, except in limited circumstances.

The grade control estimation of nickel and gangue composition, sets up all the subsequent activities (mining, blending and processing) as illustrated in FIG. 1.

A typical mining process is shown in FIG. 1: drilling 10 to analyse and estimate the ore body composition; planning 12 for planning to mine the best material for processing; mine and haul 14; stockpile, blend and reclaim 16; and processing blended ore to saleable product 18. At the drilling stage 10, drill spacing is close, and drilling and analyse cost is high. The planning 12 does not reliably deliver anticipated nickel upgrade and blended inputs, and dilution and losses high due to the very complex geology. At mining and hauling 14, mining equipment is small to selectively mine to grade and avoid dilution, and there is lots of double handling. The achievable grade is low. At the stockpiling and blending and retaining 16, there is low direct feed to processing, double handling is necessary for blending to produce an acceptable processing feed, and working capital is high. At the processing and blending 18, there is no process to beneficiate ore, and impact of nickel grade and gangue elements and total cost/ton product is very high. Nickel smelting costs are very high due to low grade.

The activities after the grade estimation are necessarily imprecise due to the orebody heterogeneity between the grade control holes.

The consequences of the uncertainty around ore estimation is the large number of stockpiles. These ore stockpiles are either used to enable the blending of feed to the processing of a consistent gangue content, or to put aside those ore blocks which are below the nickel grade desired for immediate processing, but must be mined to access other high-grade ore.

The cost of the small-scale mining equipment to improve mining precision, and the double handling of the ore to achieve the blending and to leave ore for processing late in the mine life, is significant.

Another unusual characteristic of the processing of nickel laterites, is the relative cost of mining and processing. Unlike most base metals, the cost of processing laterites is significantly higher than the cost of mining the ore.

Thus, the feed grade of the laterite fed to processing is the primary determinant of the unit cost of nickel production ($/t nickel).

For all these reasons, the use of nickel laterites has been limited to relatively few large high-grade orebodies, and technology development efforts have been focussed on finding lower cost processes for smelting or leaching of the ores as the naturally exist.

Over the past decade, in a different field of technical endeavour, sensing equipment for the on-line analysis of bulk ores is becoming increasingly available.

The potential application of bulk sorting to nickel laterites, has been considered, but is potentially problematic.

Bamber (Reference 3) in a patent covering the design of sorting equipment to separate waste from ore, suggests nickel laterites as one potential application of his proposed equipment system. He aims 'to provide a system and method of sorting mineral streams, for example laterite mineral ores, into appropriately classified valuable and waste streams for maximum recovery of value from the mineral stream'. Bamber claims the potential to bulk sort laterite ore into 2 products—ore suitable for smelting or leaching, and a waste stream for rejection.

Beyond this, the Bamber provides no guidance on how the sorting equipment could be integrated into the activities required for nickel laterite mining, blending and processing.

For example, the grade control processes for nickel laterites utilise multiple stockpiles to blend the ore prior to processing. In the conventional stockpiling strategy for nickel laterites, ore is allocated into stockpiles at multiple decision levels. The first level, as claimed by Bamber, is a separation of the fractions suited to different processing techniques such as smelting, leaching or waste.

The second decision level in grade control, is a split of ore suited to a particular processing method, into further fractions because some ore may not be sufficiently high nickel grade to be utilised immediately, but is stockpiled from treatment later in the mine life.

And the third decision level, is allocation between the multiple blending stockpiles of the ore for processing immediately, to meet the specifications for subsequent processing.

As an example of the stockpiling complexity, a laterite operation in Brasil focussed only on laterite smelting, the ore is typically split into waste stream and 7 different broad stockpile types utilising a total of around 50 concurrent stockpiles. This strategy requires effective grade control measurements of multiple elements, conducted in a timely manner to enable diversion of the ore into many different streams, based on both the measurement of gangue elements, impurities like cobalt, and the value element nickel. The amount of material re-handling is substantial with less than 10% of the ore delivered directly to the primary crusher, and onto the final blending stockpile prior to the drier.

In summary, whilst the potential for bulk sorting of nickel laterites has previously been recognised, a system for effective integration of this bulk sorting technology into the materials handling chain, has not been disclosed.

The integration of the full grade control system is particularly relevant when one considers the unusual cost structure for nickel laterites. For recovery of most metals, the mining cost per tonne is high, relative to subsequent processing costs. Bulk sorting focusses on recovery of ore from waste, and discarding modest proportions of the mining dilution below the processing cut-off-grade.

The high processing costs per tonne for nickel laterites, relative to their mining cost, makes the potential application of bulk sorting quite different. The optimum system must be configured to produce the best feed for processing, throughout the life of mine, with a minimum amount of materials re-handling.

A method to achieve these objectives is the subject of the invention.

SUMMARY OF THE INVENTION

This invention relates to a method for processing nickel laterite ore, including the steps of:

- obtaining a mined laterite ore from a mining operation; and
- feeding the ore through a bulk sorter comprising a sensor arrangement and a diverting mechanism that separates the ore into:
  - a beneficiated stream of nickel laterite ore wherein the grade of nickel is higher than the grade of the ore fed into the bulk sorter and which typically can be blended to meet the specification for further processing by leaching or smelting;
  - one or more low grade fractions of ore with a lower nickel grade than the beneficiated stream; and
  - a waste fraction for disposal.

Typically, the sensor arrangement and diverting mechanism are configured to increase the grade of nickel in the beneficiated stream by more than 5%, and preferably more than 10%, and even more preferably more than 15% relative to the ore fed into the bulk sorter.

The beneficiated stream may comprise at least 50% by mass of the ore fed into the bulk sorter.

When the beneficiated stream of nickel laterite ore is suited for smelting, it may comprise more than 1.8% typically up to 2.6% Ni by mass relative to the ore, preferably more than 2% Ni, typically about 2.2% Ni.

When the beneficiated stream of nickel laterite ore is suited for leaching, it may comprise more than 1% typically up to 1.6% Ni by mass relative to the ore, preferably more than 1.3% Ni, typically about 1.45% Ni.

The low-grade ore fractions may be deposited into multiple low-grade stockpiles.

Preferably, the sensor simultaneously measures and records the nickel and the gangue and impurity elements such as $SiO_2$, MgO, Co and Fe in the beneficiated stream/s and the low grade stockpiles.

The recorded measurements of nickel and gangue and impurity elements may be used in blending of the low grade stockpile/s with a beneficiated stream, to meet processing specifications of the further processing of the beneficiated stream by leaching or smelting.

When the mining operation comprises grade control drilling, each drill hole spacing may be at least 15 m, preferably greater than 15 m.

The bulk sorter may be configured to reject the waste that occurs due to inaccurate loading from the mine face.

The bulk sorter may be configured to sort material below cut-off-grade to recover high grade patches of ore within the grade control block in the mining operation.

The bulk sorter may be incorporated into a mobile or relocatable system, that is progressively relocated and maintained within 500 m, and more preferably within 200 m, and even more preferably within 100 m of the active mining face in the mining operation.

More than 70%, and preferably more than 80% and even more preferably more than 90% of the waste fraction, may be redeposited directly into an area disturbed by the mining operation.

More than 70%, and preferably more than 80% and even more preferably more than 90% of the low-grade fractions may be deposited directly in the area previously disturbed by the mining operation, for temporary storage.

The recorded sensor information may be used to reduce double handling of beneficiated ore, such that less than 30% and preferably less than 20% and even more preferably less than 10% of beneficiated ore is stored in a blending stockpile prior to delivery to the processing facility.

The recorded sensor information may be used for stockpile management to enhance the control the gangue and impurity elements fed to processing, to preferably within 10% and even more preferably within 5% of the desired daily feed ratios.

Multiple bulk sorters may be located at different mining faces in the mining operation, and each sorter produces a beneficiated stream to feed a central processing facility.

Bulk sorting may be used to beneficiate the ore prior to transportation to a remote processing facility.

The bulk sorter may be used to identify and separate ore that is particularly suited to further upgrade by screening.

The nickel grade from sorting may be adjusted periodically to reflect the grade of the remaining resource and/or the nickel price of the product.

The process may be configured to transform a low-grade resource into a nickel orebody that warrants processing.

Preferably, heterogeneity is maintained by avoiding homogenisation of the ore during mining, loading and haulage of the ore, to maintain the spatial integrity of the natural ore body.

Preferably, the ore is not mixed, for example by stockpiling prior to bulk sorting.

An embodiment of the invention relates to a method of optimisiming the mining and processing of nickel laterite ore includes:

i) carrying out grade control procedures such as drill hole analysis to widen the spacing in mining of the laterite ore;

ii) feeding mined ore to a bulk sorter comprising a sensor arrangement and a diverting mechanism that separates the ore into:

a beneficiated stream of nickel laterite ore wherein the grade of nickel is higher than the grade of the ore fed into the bulk sorter for further processing by leaching or smelting;

one or more low grade fractions of ore with a lower nickel grade than the beneficiated stream; and a waste fraction for disposal; wherein:

the sensor in the bulk sorter simultaneously measures and records the nickel and gangue impurity elements such as $SiO_2$, MgO, Co and Fe in the beneficiated stream/s and the low grade stockpiles; and the recorded measurements of nickel and gangue and impurity elements are used:

in blending of the low grade stockpile/s with a beneficiated stream, to meet processing specifications of the further processing of the beneficiated stream, by leaching or smelting; and in the mining grade control procedures such as drill hole analysis to widen the drill hole spacing overall mining process.

DETAILED DESCRIPTION OF THE INVENTION

The current invention is a configuration of the mining and materials handling processes for nickel laterite ores, that efficiently separate lower grade patches in the run of mine ore, to either a low-grade stockpile or waste, and efficiently blends the selected high-grade ore to meet the specifications of the subsequent processing.

This configuration allows significantly increased production at lower unit cost, than that used in existing grade control processes, by utilising the spatial heterogeneity of the ore, to separate the patches of the ore into different streams.

The spatial heterogeneity of the nickel content of the ore, can be expressed in the form of a grade tonnage curve. In the FIG. 2, the grade tonnage curve of a Brasilian nickel laterite orebody is illustrated in terms of the grade and tonnage relationship for 50 tonne discrete packages of ore, using a cut-off-grade of 0.9% nickel.

Below 0.9% the remaining nickel bearing materials in the mining area are considered as waste, as they are uneconomic to process through the processing facilities, despite having patches of ore within the grade control block that are of adequate grade.

Often, this waste must be mined, and transported to a waste pile, simply to access the adjacent higher-grade ore.

A similar shape of grade tonnage curve exists for acidic fraction of the laterite orebody.

Figure 1:
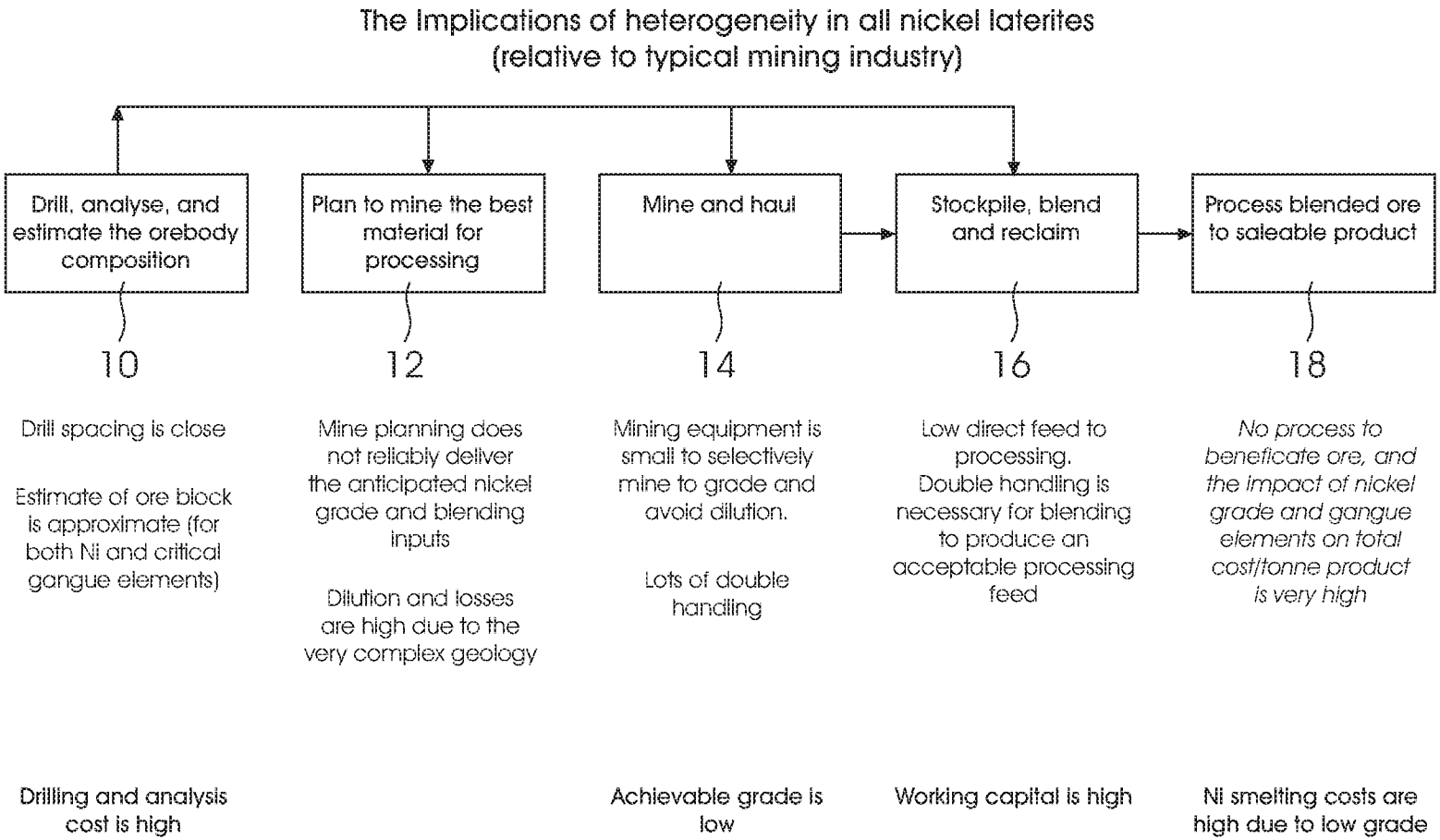
FIG. 1 is a block diagram showing the heterogeneity in nickel laterites relative to a typical mining industry.
Figure 2:
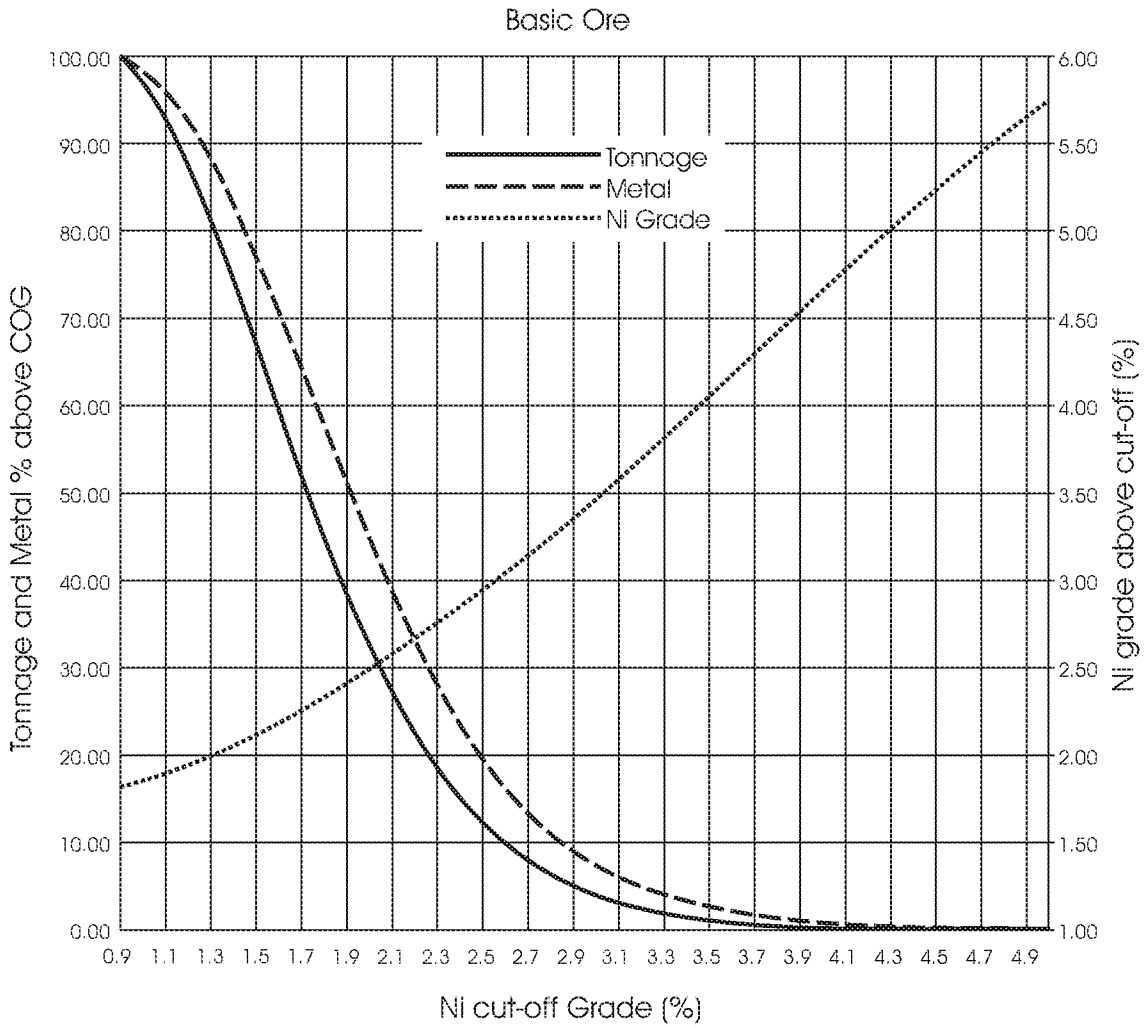
FIG. 2 is a graph showing the estimated grade tonnage curve for a Brasilian laterite ore.

It is evident from FIG. 2 that if for example, it was possible to selectively mine individual 50 tonne packages of ore from within the overall orebody grading 1.8%, that the grades of these best packages would contain well above 4% nickel.

However, such mining processes are impractical, because of the spread of the high-grade patches across all dimensions of the orebody. Thus, mining occurs sequentially, and a composite of the ore from the area being mined is allocated to the processing plant. Only limited opportunity exists for use of grade control techniques to demarcate those areas where the estimated grade is below that ideally suited to processing immediately, but not below the ultimate cut-off-grade. Where these areas of ore prevent access the higher-grade ore, they are typically mined and stockpiled for subsequent reclamation late in the mine life.

The level of heterogeneity evident in the shape of the curve in FIG. 2, indicates that bulk sorting has potential for beneficiating nickel laterites, as distinct from the more normal application of sorting of waste from ore, or the separation of ore suited to smelting from the ore suited for leaching.

However, to use bulk sorting to beneficiate the ore purely on nickel grade, could inadvertently cause significant issues in the blending required to achieve gangue elements within specification for processing. For example, if the magnesium content were strongly correlated with the nickel content, such beneficiation would render the ore un-processable.

The wider system for beneficiating nickel using bulk sorting, must also accommodate grade of gangue elements. This distribution is illustrated for the same 50 t packages of ore in FIG. 3.

The gangue content is relatively independent of nickel grade in that package at the 50-tonne package level. The data implies that if the nickel laterite ore were bulk sorted to beneficiate the nickel grade, there would be only modest implications for balancing the gangue minerals in the overall deposit.

Figure 3:
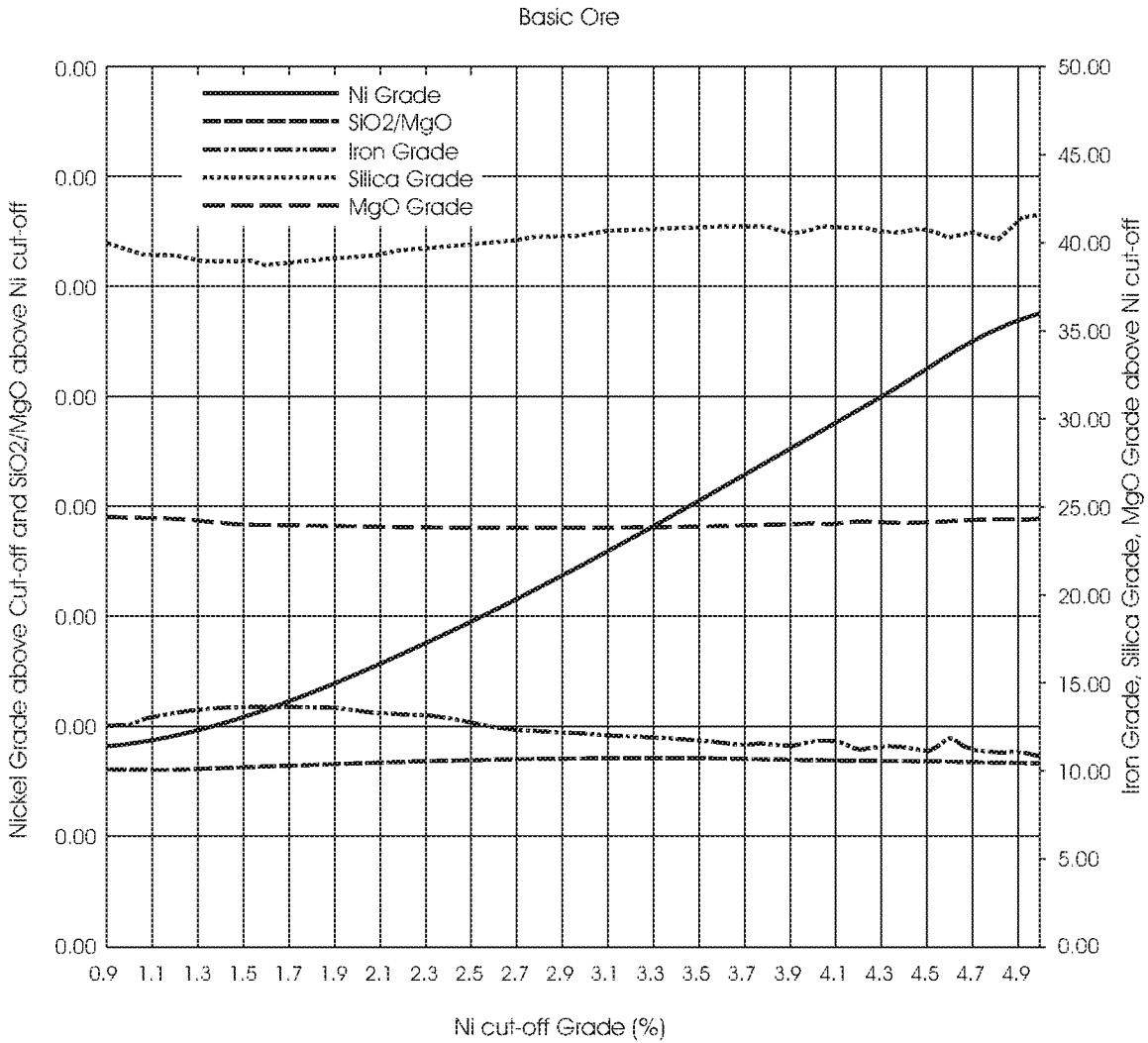
FIG. 3 is a graph showing the impact of sorting on gangue concentrations in the sorted blocks.

Again, similar results to those in FIG. 3, were also evident for acidic ores. Using the bulk sorting technology that has been developed to sense and divert laterite ores into ore and waste streams (references 3,4,5), the grade tonnage relationships indicate that nickel laterite ores can be beneficiated into a desired grade, leaving a lower grade fraction as waste or for stockpiling and use later in the mine life.

Whilst measuring nickel content, the appropriately selected sensor can concurrently deliver a multielement analysis of the ore, probably at an accuracy better than conventional grade control processes. This source of data can then be used to increase the precision and efficiency of blending gangue materials.

In any area being sequentially mined, the bulk sorting system that is the subject of this invention can select the best patches of grade for processing now, and separate the remaining ore into both a waste stream and multiple low-grade stockpiles. Concurrently, the measurement of the gangue content (as illustrated schematically in FIG. 4) can be used to provide more precise inputs to the subsequent activities of blending and processing.

Figure 4:
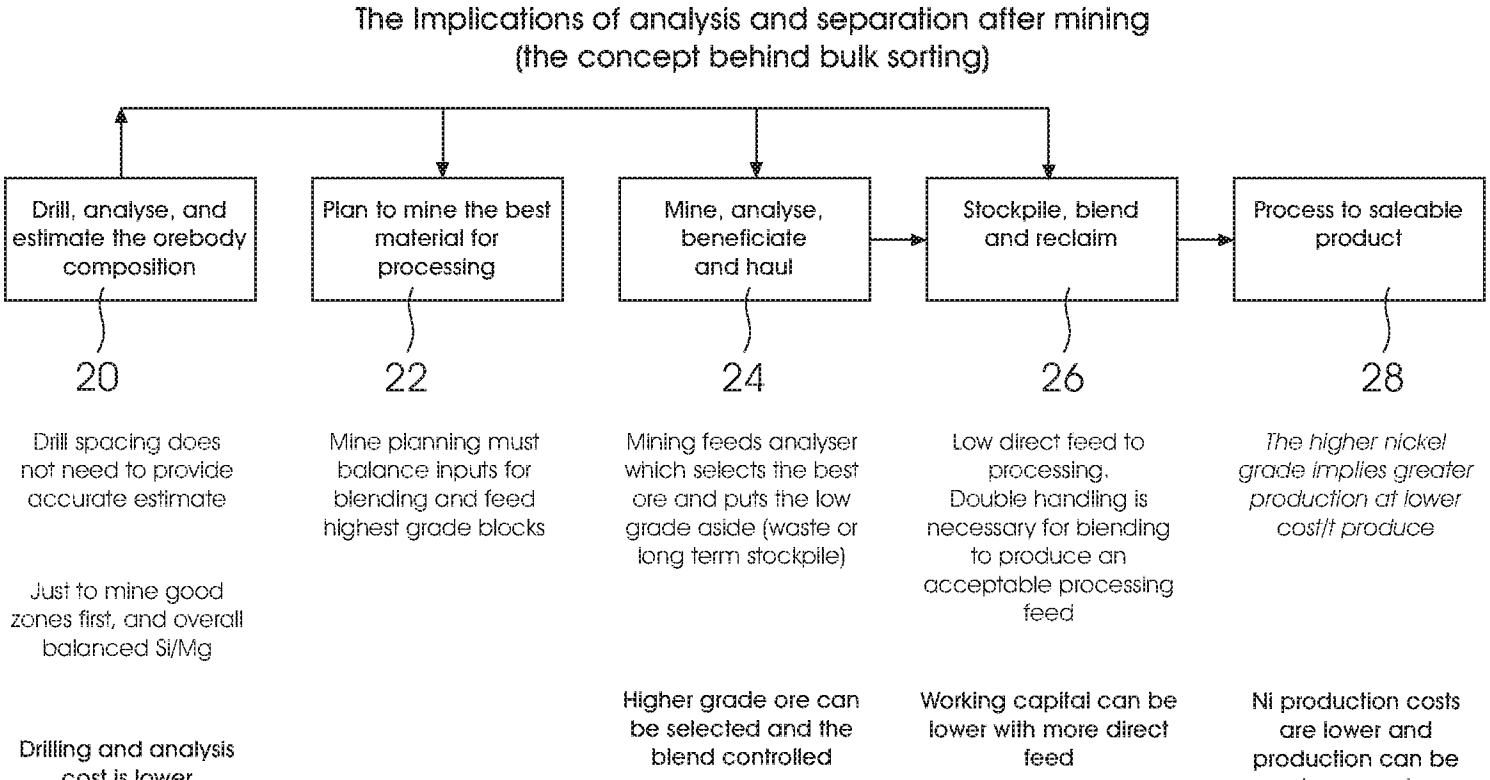
FIG. 4 is a block diagram showing material flows arising from using bulk sorting in a laterite mine.

With reference to FIG. 4, an embodiment of the invention comprises the following stages: drill and analysing stage 20; planning stage 22; mine analyse and beneficiate and haul stage 24; stockpile blend and reclaim stage 26; and process to saleable product stage 28. In the drilling stage 20, drilling spacing does not need to provide accurate estimate, just to mine good zones first, and overall balanced Si/Mg. Drilling and analysis cost is lower. In the planning stage 22, mine planning must balance inputs for blending and feed highest grade blocks. In stage 24, mining feeds analyser selects the best ore and puts the low grade aside (waste or long term stockpile). Higher grade ore can be selected and the blend controlled. Mining rate is increased to keep smelter full. Mining equipment can be larger (as the exact digging of the material is no longer so critical). At stage 26, there is a low direct feed to processing. Double handling necessary for blending to produce an acceptable processing feed. Working capital can be lower with more direct feed. At stage 28, higher nickel grade eimplies greater production at lower cost/profit. Nickel production costs are lower and production can be increased.

Figure 5:
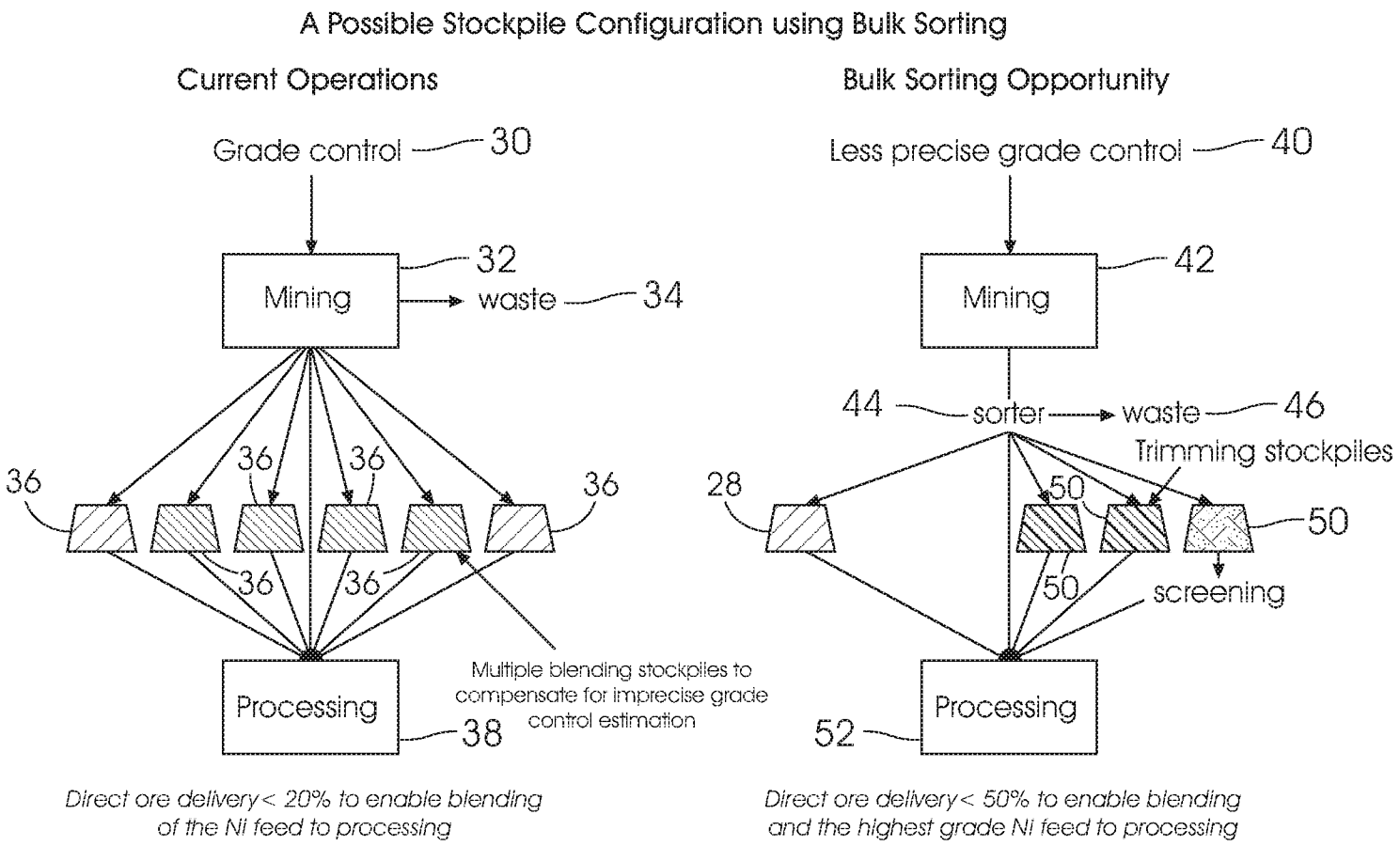
FIG. 5 is a block diagram showing the impact of bulk sorting on material flows and stockpiling.

This enhanced information provides an opportunity to streamline the stockpiling activity (as illustrated schematically in FIG. 5). Precise knowledge of the gangue compositions can be gathered from multiple ore sources hauled to a single sorter, or from multiple sorters located close to the different mining faces across the orebody.

With reference to FIG. 5, current operations comprise grade control 30 and mining 32. From the mining, there is a waste stream 34 and multiple blending stockpiles 36 are required to compensate for imprecise grade control estimation, which are used for further processing 38. Direct ore delivery is less than 20% to enable blending of nickel feed to processing. According to an embodiment of the process of the present invention, less precise grade control 40 is required. After mining 42 ore is sent to a bulk sorter 46. The bulk sorter sorts a waste stream 44, a beneficiated faction 48 for further processing, and low grade factions 50 which can be used as trimming stockpiles in further processing 52. Direct ore delivery is less than 50% to enable blending and the highest grade nickel feed to processing.

The sensors have been developed.

The bulk sorter 46 comprises a sensor arrangement for analysis of ores, typically by irradiation of the ore on conveyors running at normal speed, and measuring the resultant signal consistent with the characteristics of the ore integrated with a diverterting mechanism to separate different fractions of the ore (References 3-6, incorporated herein by reference). For example, the GEOSCAN utilises the technique known as Prompt Gamma Neutron Activation Analysis (PGNAA). The GEOSCAN incorporates high efficiency detectors and state-of-the-art digital spectrometer, which overcomes the limitations of conventional, low efficiency detection systems. Whilst these sensors have predominantly in the past been used for blending of products to meet market specifications, accoring to the present inventionm they can be used to measure and reject waste present in the incoming ore. Used in this mode, the sensing and separation is termed bulk sorting. Another example is the Sodern CNA-Nickel online elemental analyzer, based on the PFTNA (Pulsed Fast and Thermal Neutron Activation) technology.

A few commercial bulk sorting operations have been proposed or commissioned, mainly in the iron ore and copper applications, to separate ore for subsequent processing from waste for disposal. The waste may be naturally occurring, or a consequence of dilution that occurs during mining. In these cases, the bulk sorter is used to reject waste prior to the processing facility, not as an integrated part of the overall materials flow from mining to processing.

This information can enable a higher proportion of beneficiated ore to be delivered direct to a final blending stockpile prior to processing, rather than via multiple intermediate blending stockpiles.

In any mining sequence, there will be times when the gangue elements from the different mine faces are not balanced. In these circumstances, and depending on nickel grade and gangue composition, the more extreme gangue compositions can be assigned by the bulk sorter to a trimming stockpile or to waste.

The trimming stockpile can then be reclaimed when required for balancing the feed in the other direction.

In the case of smelting requiring the blending of acidic and basic ores to achieve an appropriate silica to magnesia ratio, this approach enables efficient mining and stockpiling, but also enables the disposal to waste of the least attractive materials for a given orebody.

The invention of the bulk sorting system for nickel laterites, in its full embodiment, consists of

- Grade control procedures and mining of the laterite ore, are adapted to the spacing and equipment size to optimise the overall mining process
  - Mining locations and sequences are selected to contain acceptable nickel grades and produce the approximate mix of ore required to meet processing specifications
  - The scale of mining equipment and the mining procedures are adapted to utilise the lower impact of dilution, which is managed by the sorter
- Ore is fed directly from mining to the bulk sorter without an intervening stockpile.
  - Loading of the bulk sorter can be by truck, or directly from the loader to a mobile sorter.
  - If the sensor is in the loader rather than on a conveyor, diversion is achieved through a truck allocation technology.
- The sensor determines the average grade of a package of ore, and the diverter directs the 'packages' into multiple different destinations, depending on their composition.
- The lower grade patches of nickel ores, or those with unacceptable ratios of gangue, are separated and allocated to one of the following streams
  - discarded if they are uneconomic to process using the installed processing assets
  - temporary storage in trimming stockpiles if they are a high nickel grade but outside of the preferred grade for direct feed to processing.
  - long term storage stockpiles, if the ore package contains an economic nickel grade, but not the highest grade available to process now.
  - to screening or separate stockpiles if the ore type contains a nickel grade and mineral assemblage that is amenable to further beneficiating by screening
- The beneficiated stream of nickel laterite ore, that is within or close to the specification required for further processing, is directed to the processing feed.
- The trimming of gangue compositions occurs by reclaiming of ore of known composition from one of the trimming stockpiles For different nickel laterite operations, all or part thereof of this full embodiment will be required.

Critical elements to effectively managing the nickel grade enhancement and materials handling in this invention are:

- Avoiding homogenisation as much as possible during the mining, loading and haulage of ore, to maintain the spatial integrity of the natural orebody as it is presented to the bulk sorter
- Adjusting the mining rate, to generate a high grade of beneficiated nickel laterite at the production rate demanded by the available processing capacity
- Adjusting the mine plan to balance the gangue elements, to avoid the need for multiple, large scale blending stockpiles after bulk sorting and prior to processing
- Utilising the accumulated sensor data to control the reclaim from trimming stockpiles to balance the gangue components of the direct feed.

Through integrating the mining, sorting and blending process in the current invention it is possible to increase the grade of the laterite ores sent to production, whilst reducing double handling, and improving the precision of blending.

As evident in the grade tonnage curves (FIGS. 2 and 3), it is possible to generate a very high-grade feed with a relatively low tonnage yield, or a slightly increased nickel grade but with a high tonnage yield.

By changing the grade selected in bulk sorting, it becomes possible to adjust the processing feed to an economic optimum value for the specific orebody being mined. And to progressively alter these grades through the remaining life of mine.

The invention also increases the available flexibility in the design and operation of the nickel laterite mining activity, particularly where the bulk sorters are located close to or in the mining areas.

For example,

- Spacing between grade control drill-holes can be increased
- Waste can be stacked within the mining zone
- Dilution can be less stringently managed during mining
- Resource recovery can be enhanced by separating the high-grade ore patches from grade control blocks just under the current mining cut-off-grade
- The scale of mining and haulage equipment can be increased, subject to limiting homogenisation
- The amount of material re-handling in the mine can be reduced For an embodiment of the invention where the sorting is undertaken in a mobile or relocatable system, the bulk sorter can be moved to remain in or close to the mining pit. This enables a very short haul distance for the medium grade ore, prior to beneficiation. It also enables the waste to be redeposited in the mined-out area, with minimal cost of haulage and mine restoration.

The material for the low-grade stockpile material can also be placed in a mined-out zone, minimising the land disturbance.

Only beneficiated ore from bulk sorting is hauled a significant distance to the processing facility, thus reducing overall haulage costs per tonne of nickel produced.

In another embodiment to the invention, bulk sorting is combined with screening.

Beneficiation by screening (based on differential nickel grade at different particle sizes) is based on a different principle from the beneficiation by bulk sorting (spatial heterogeneity). Thus, screening and bulk sorting are complementary and can be utilised in sequence on a laterite ore. If an ore domain is such that screening delivers an economic upgrade, the bulk sorter can sense and separate that ore domain, thus segregating the fraction well suited to screening. This enhances the nickel upgrade and reduces the capital and operating costs of the screening plant.

If, as for some nickel laterites, screening is only realistic with partially dried ore, bulk sorting enables on the appropriate ore to be segregated and stockpiled awaiting subsequent screening in the dry season.

In yet another embodiment of the invention, the location of mining can be balanced to provide the approximate blend in the feed to processing. The bulk sorter is adjusted to deliver a precise gangue composition to processing, at high nickel grade.

The modest fractions of the ore that meet the selected nickel grade but cannot be fitted into the gangue specifications at a specific time, can be stockpiled, as trimming stockpiles.

The resultant increase in direct feed reduces the working capital and cost of materials re-handling. Direct deliveries can be enhanced from less than 10% to well above 50% and depending on the balance in mining, approaching 100%.

In yet another embodiment of the invention, the nickel content of the feed can be adjusted using bulk sorting, to respond to changes in the nickel price, or the grade and tonnage of the resource that is still available to mine. Thus, the value of the resource can be optimised over time. And in yet another configuration of the invention, a bulk sorter can be used to beneficiate the nickel laterite, thus generating an ore that justifies transportation to a remote processing facility.

The following documents are incorporated herein by reference:

REFERENCE 1

ATTEMPTS AT THE BENEFICIATION OF LATERITIC NICKEL ORE. Onodera, Jiroh (1); Inoue, Toshio (1); Imaizumi, Tsunemasa (1) Source: *International Journal of Mineral Processing*, v 19, n 1-4, p 25-42, May 1985; ISSN: 03017516; DOI: 10.1016/0301-7516(87)90030-5; Conference: Proc of the Int Symp on Laterite, Oct. 14, 1985-Oct. 17, 1985

REFERENCE 2

Physical separations as potential techniques for preconcentration of nickel laterites Keith Quast (Future Industries Institute, University of South Australia) Jonas Addai-Mensah (Future Industries Institute, University of South Australia) William Skinner (Future Industries Institute, University of South Australia) 2016 Chemeca Conference 2016 (Adelaide, Australia 25-28 Sep. 2016)

REFERENCE 3

US20130201481A1

REFERENCE 4

MetPlant2015 Metallurgical Plant Design and Operating Strategies—World's Best Practice Perth, Australia 7-8 Sep. 2015 ISBN: 978-1-5108-2145-3 Optimising Plant Feed Quality and Process Performance Using Geoscan Elemental Analysis H Kurth 373

REFERENCE 5 https://www.scantech.com.au/solution/nickel/

REFERENCE 6

Malvern Panalytical Sodern CAN-Nickel brochure https://www.malvernpanalyrical.com/en/products/product-range/cna-range/cna-nickel

The invention claimed is:

1. A method for processing nickel laterite ore, including the steps of:

obtaining a mined laterite ore from a mining operation; and feeding the ore through a bulk sorter comprising a sensor arrangement and a diverting mechanism that separates the ore into:

a beneficiated stream of nickel laterite ore wherein the grade of nickel in the beneficiated stream is increased by more than 10% relative to the ore fed into the bulk sorter, where the beneficiated stream comprises at least 50% by mass of the ore fed into the bulk for further processing by leaching or smelting;

one or more low grade fractions of ore with a lower nickel grade than the beneficiated stream which are deposited into low grade stockpiles; and a waste fraction, wherein the sensor arrangement is configured to simultaneously measure and record the nickel and the gangue and impurity elements, including SiO2, MgO, Co and Fe, in the beneficiated stream and the low grade stockpiles and the method further comprising a step of blending the low-grade stockpiles with the beneficiated stream prior to further processing of the beneficiated stream by leaching or smelting and wherein an amount of the low-grade stockpiles and an amount of the beneficiated stream for blending are determined from the recorded measurements.

2. The method claimed in claim 1, wherein the grade of nickel in the beneficiated stream is increased by more than 15% relative to the ore fed into the bulk sorter.

3. The method claimed in claim 1, wherein the beneficiated stream of nickel laterite ore comprises more than 1.8% and up to 2.6% Ni by mass relative to the ore and is selected for further processing by smelting.

4. The method claimed in claim 3, wherein the beneficiated stream of nickel laterite ore comprises more than 2% and up to 2.6% Ni by mass relative to the ore.

5. The method claimed in claim 4, wherein the beneficiated stream of nickel laterite ore comprises more than 2.2% and up to 2.6% Ni by mass relative to the ore.

6. The method claimed in claim 1, wherein the beneficiated stream of nickel laterite ore comprises more than 1% and up to 1.6% Ni by mass relative to the ore and is selected for further processing by leaching.

7. The method claimed in claim 6, wherein the beneficiated stream of nickel laterite ore comprises more than 1.3% and up to 1.6% Ni by mass relative to the ore.

8. The method claimed in claim 7, wherein the beneficiated stream of nickel laterite ore comprises more than 1.45% and up to 1.6% Ni by mass relative to the ore.

9. The method as claimed in claim 1, wherein the mining operation comprises grade control drilling, wherein drill hole spacing is at least 15 m.

10. The method as claimed in claim 9, wherein the mining operation comprises grade control drilling, wherein drill hole spacing is greater than 15 m.

11. The method as claimed in claim 1, wherein the waste includes ore derived from a mine face having a nickel grade that is lower than the low grade fraction.

12. The method as claimed in claim 1, in which the bulk sorter is configured to sort material below cut-off-grade to recover high grade patches of ore within a grade control block in the mining operation.

13. The method as claimed in claim 1, where the bulk sorter is incorporated into a mobile or relocatable system that is progressively relocated and maintained within 500 m of an active mining face in the mining operation.

14. The method as claimed in claim 13, where the bulk sorter is incorporated into a mobile or relocatable system that is progressively relocated and maintained within 200 m of the active mining face in the mining operation.

15. The method as claimed in claim 14, where the bulk sorter is incorporated into a mobile or relocatable system that is progressively relocated and maintained within 100 m of the active mining face in the mining operation.

16. The method as claimed in claim 13, in which more than 70% of the waste fraction is redeposited directly into an area disturbed by the mining operation.

17. The method as claimed in 23, in which more than 80% of the waste fraction is redeposited directly into an area disturbed by the mining operation.

18. The method as claimed in claim 17, in which more than 90% of the waste fraction is redeposited directly into an area disturbed by the mining operation.

19. The method as claimed in claim 1, in which more than 70% of the low-grade fractions is deposited directly in the area previously disturbed by the mining operation, for temporary storage.

20. The method as claimed in claim 1, in which more than 80% of the low-grade fractions is deposited directly in the area previously disturbed by the mining operation, for temporary storage.

21. The method as claimed in claim 1, in which more than 90% of the low-grade fractions is deposited directly in the area previously disturbed by the mining operation, for temporary storage.

22. The method as claimed in claim 1, wherein less than 30% of beneficiated ore is stored in a blending stockpile prior to further processing of the beneficiated stream by leaching or smelting.

23. The method as claimed in claim 22, wherein less than 20% of beneficiated ore is stored in a blending stockpile prior to further processing of the beneficiated stream by leaching or smelting.

24. The method as claimed in claim 23, wherein less than 10% of beneficiated ore is stored in a blending stockpile prior to further processing of the beneficiated stream by leaching or smelting.

25. The method as claimed in claim 1, wherein multiple bulk sorters are located at different mining faces in the mining operation, and each sorter produces a beneficiated stream to feed a central processing facility.

26. The method as claimed in claim 1, wherein the bulk sorting separates the ore into the beneficiated stream prior to transportation to a remote processing facility.

27. The method claimed in claim 1, wherein the ore is not homogenized prior to bulk sorting.

28. The method claimed in claim 27, wherein the ore is not mixed prior to bulk sorting.

29. A method of optimising the mining and processing of nickel laterite ore includes:

i) carrying out grade control drilling in mining of the laterite ore with drill hole spacing greater than about 15 m;

ii) feeding mined ore to a bulk sorter comprising a sensor arrangement and a diverting mechanism that separates the ore into:

a beneficiated stream of nickel laterite ore wherein the grade of nickel in the beneficiated stream is increased by more than 10% relative to the ore fed into the bulk sorter, where the beneficiated stream comprises at least 50% by mass of the ore fed into the bulk sorter, for further processing by leaching or smelting;

one or more low grade fractions of ore with a lower nickel grade than the beneficiated stream which are deposited in multiple low grade stockpiles;

a waste fraction; and blending the low grade stockpile/s and beneficiated stream to produce a blend having a selected level of nickel, gangue, and impurity elements to meet processing specifications of the beneficiated stream, by leaching or smelting.

30. The method of claim 29, wherein the sensor arrangement is configured to simultaneously measure and record the nickel and the gangue and impurity elements, including $SiO_2$, MgO, Co and Fe, in the beneficiated stream and the low grade stockpiles and wherein an amount of the low-grade stockpiles and an amount of the beneficiated stream for blending are determined from the recorded measurements.

* * * * *